US010247511B2

(12) United States Patent
Malarkey

(10) Patent No.: US 10,247,511 B2
(45) Date of Patent: Apr. 2, 2019

(54) PROJECTILE LAUNCHER

(71) Applicant: X Products LLC, Vancouver, WA (US)

(72) Inventor: James Malarkey, Nashville, TN (US)

(73) Assignee: X PRODUCTS LLC, Vancouver, WA (US)

( * ) Notice: Subject to any disclaimer, the term of this patent is extended or adjusted under 35 U.S.C. 154(b) by 0 days.

(21) Appl. No.: 15/422,419

(22) Filed: Feb. 1, 2017

(65) Prior Publication Data

US 2018/0216910 A1 Aug. 2, 2018

(51) Int. Cl.

| | |
|---|---|
| ***F41C 3/00*** | (2006.01) |
| ***A63B 69/40*** | (2006.01) |
| ***F41B 11/60*** | (2013.01) |
| ***F41B 11/80*** | (2013.01) |
| ***F41A 1/00*** | (2006.01) |
| ***F41A 21/26*** | (2006.01) |
| ***F41C 9/08*** | (2006.01) |

(52) U.S. Cl.

CPC ..... *F41C 3/005* (2013.01); *A63B 69/409* (2013.01); *F41A 1/00* (2013.01); *F41A 21/26* (2013.01); *F41B 11/60* (2013.01); *F41B 11/80* (2013.01); *F41C 9/08* (2013.01)

(58) Field of Classification Search

CPC ..... F41C 3/005; F41C 27/06; A63B 69/409; F41J 9/18

See application file for complete search history.

(56) References Cited

U.S. PATENT DOCUMENTS 2,390,738 A * 12/1945 Rutherford ..... F41C 27/06 42/105
2,481,546 A * 9/1949 Walker ..... F41C 27/06 42/105
3,004,360 A 10/1961 Johnson
3,176,421 A * 4/1965 Nass ..... F41J 9/18 124/41.1
3,186,119 A * 6/1965 Maras ..... F41J 9/18 124/41.1

(Continued)

OTHER PUBLICATIONS

Randy Ludacer, "The Targeteer Beer Can Launcher," http://beachpackagingdesign.com/boxvox/the-targeteer-beer-can-launcher, Published May 14, 2013, Accessed Aug. 7, 2016.

(Continued)

*Primary Examiner* — Benjamin P Lee
(74) *Attorney, Agent, or Firm* — Bennet K. Langlotz; Langlotz Patent & Trademark Works, LLC

(57) ABSTRACT

Projectile launchers have an elongated cylindrical body defining a projectile bore having a bore axis, the body having an open forward exit end, the body having a gas inlet facility at an opposed rear end, a movable latch element connected to the body and having a latch portion movable between a retention position in which the latch portion protrudes into the bore and a release position, and the latch element being biased to the retention position such that a projectile in the bore rearward of the latch is retained by the latch portion except until a gas pressure above a selected amount builds up behind the projectile to overcome the biasing of the latch and launch the projectile. The latch element may be clear of the bore when in the release position.

18 Claims, 3 Drawing Sheets

(56) References Cited

U.S. PATENT DOCUMENTS

| | | | | | |
|---|---|---|---|---|---|
| 3,243,909 | A * | 4/1966 | Kotikov | F41C 27/06 | 102/483 |
| 3,318,033 | A * | 5/1967 | Barr | F41C 27/06 | 102/483 |
| 3,404,479 | A * | 10/1968 | Silsby | F41A 5/16 | 42/105 |
| 3,826,031 | A * | 7/1974 | Gabriels | F41C 27/06 | 102/483 |
| 4,098,015 | A * | 7/1978 | Walbe | A01K 15/02 | 42/105 |
| 4,307,529 | A * | 12/1981 | White | A01K 15/02 | 340/12.5 |
| 4,799,906 | A * | 1/1989 | Perkins, Jr. | B63C 9/22 | 102/504 |
| 2010/0281745 | A1* | 11/2010 | Condon | F41C 27/06 | 42/90 |
| 2014/0013985 | A1* | 1/2014 | Kravel | F42B 12/48 | 102/334 |

OTHER PUBLICATIONS

Ncstar, Inc., "AR15 Golf Ball Launcher," http://ncstar.com/product/product-detail.aspx?ModelNo=AGOLF&GroupNo=0, (c) 2004-2016, Accessed Aug. 7, 2016.

* cited by examiner

PROJECTILE LAUNCHER

FIELD OF THE INVENTION

The present invention relates to projectile launcher, and more particularly to a projectile launcher that retains a projectile until a selected amount of gas pressure accumulates behind the projectile and prevents the use of live ammunition with the launcher.

BACKGROUND OF THE INVENTION

Projectile launchers have long been popular for a number of purposes, including launching T-shirts as promotional prizes, launching empty beer cans as shooting targets, training retrievers, simulating launched grenades, and launching golf balls or potatoes for the user's entertainment. Examples of prior art projectile launchers include U.S. Pat. No. 3,004,360 to Johnson that launches an empty beer can using the propulsive force of a blank 0.22 cartridge, and the AR15 Golf Ball Launcher manufactured by NcSTAR, Inc. of City of Industry, Calif.

While the prior art projectile launchers largely achieve their goals of launching the projectiles each is designed to launch, they both have significant disadvantages. The '360 patent's use of 0.22 blank cartridges was suitable for launching empty flat top steel beverage cans made in the 1960s when the invention was developed, but modern empty lightweight aluminum cans are likely to be crushed by the propulsive force of a 0.22 blank cartridge. The '360 patent also relies on the presence of an external bead on the can to create a seal with a ring of resilient material to build pressure, which does not exist on modern empty lightweight aluminum cans. The pressure buildup is also potentially variable depending on an individual blank cartridge's characteristics, a can's dimensions, and the condition of the ring. The pressure build up is also insufficient to launch a full can.

The '360 patent uses a combustion chamber that closely receives a blank 0.22 cartridge with the described intention of preventing the use of loaded ammunition instead of a blank cartridge. However, a production model of the invention was reportedly tested by Australian police in 1965 and found to be capable of firing a 0.22 bullet if a can is not in place. The '360 patent's ability to fire live ammunition would greatly increase dangers associated with use of the '360 patent and likely subject it to firearm regulations.

The NcStar, Inc. launcher uses 5.56 blank cartridges to launch golf balls. It has the disadvantage of requiring the use of a fully functional AR-15, M4, or M16 rifle without providing any ability to prevent the use of live ammunition with the launcher instead of blank cartridges. It also does not retain the golf ball until a gas pressure above a selective amount builds up behind the golf ball.

Therefore, a need exists for a new and improved projectile launcher that retains a projectile until a selected amount of gas pressure accumulates behind the projectile and prevents the use of live ammunition with the launcher. In this regard, the various embodiments of the present invention substantially fulfill at least some of these needs. In this respect, the projectile launcher according to the present invention substantially departs from the conventional concepts and designs of the prior art, and in doing so provides an apparatus primarily developed for the purpose of retaining a projectile until a selected amount of gas pressure accumulates behind the projectile and preventing the use of live ammunition with the launcher.

SUMMARY OF THE INVENTION

The present invention provides an improved projectile launcher, and overcomes the above-mentioned disadvantages and drawbacks of the prior art. As such, the general purpose of the present invention, which will be described subsequently in greater detail, is to provide an improved projectile launcher that has all the advantages of the prior art mentioned above.

To attain this, the preferred embodiment of the present invention essentially comprises an elongated cylindrical body defining a projectile bore having a bore axis, the body having an open forward exit end, the body having a gas inlet facility at an opposed rear end, a movable latch element connected to the body and having a latch portion movable between a retention position in which the latch portion protrudes into the bore and a release position, and the latch element being biased to the retention position such that a projectile in the bore rearward of the latch is retained by the latch portion except until a gas pressure above a selected amount builds up behind the projectile to overcome the biasing of the latch and launch the projectile. The latch element may be clear of the bore when in the release position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
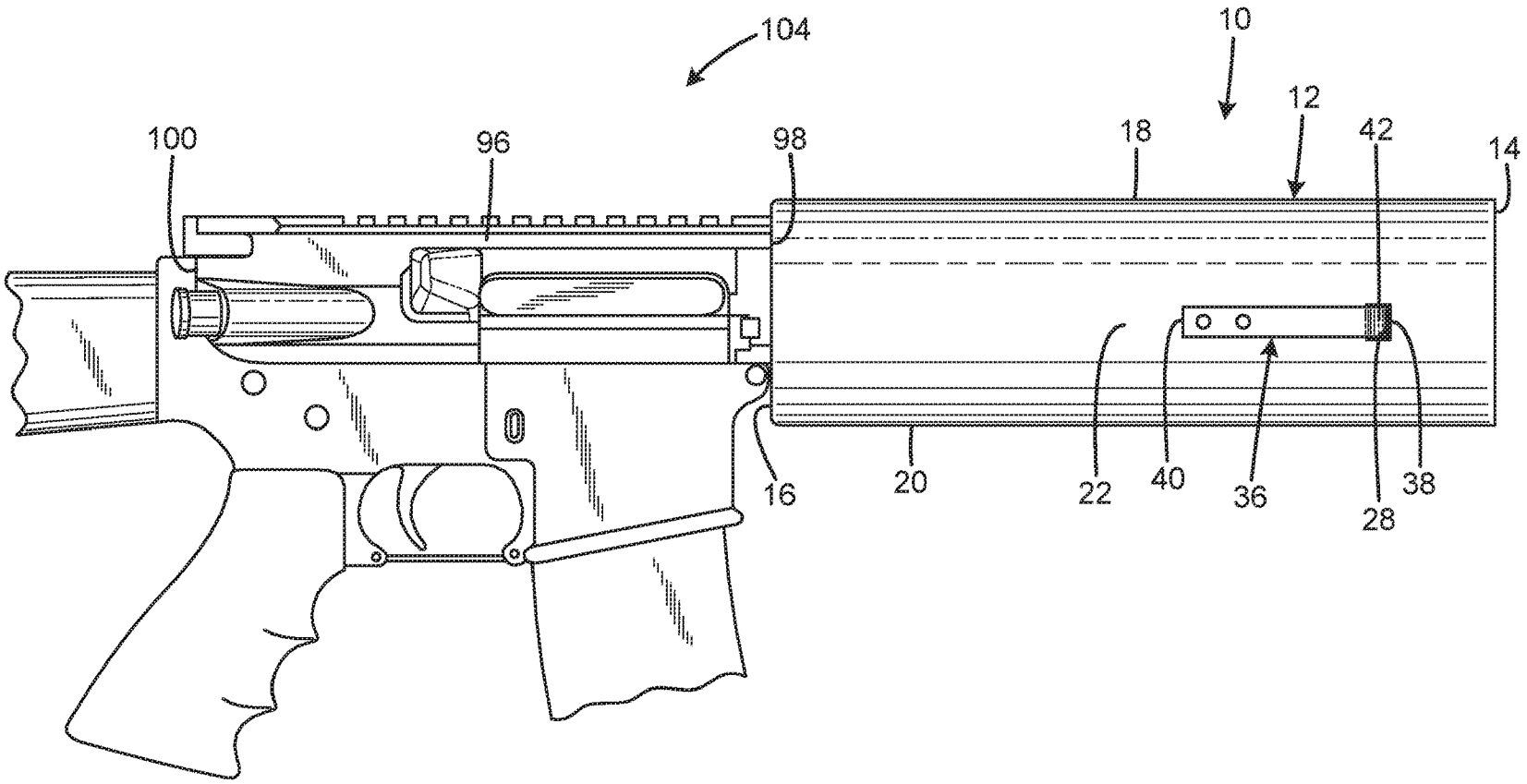
FIG. 1 is a right side view of the current embodiment of the projectile launcher constructed in accordance with the principles of the present invention.

An embodiment of the projectile launcher of the present invention is shown and generally designated by the reference numeral 10.

Figure 2:
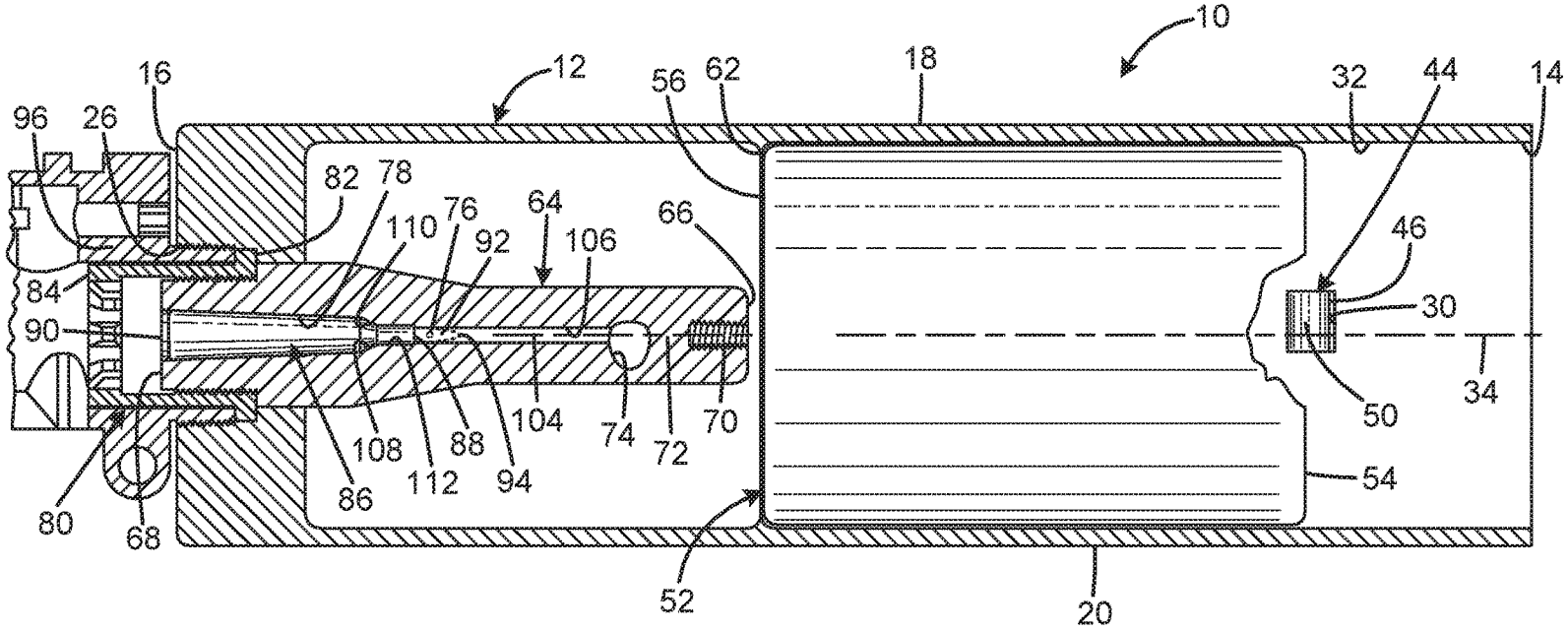
FIG. 2 is a top sectional view of the current embodiment of the projectile launcher of FIG. 1 with a projectile loaded and the latch elements in the retention position.

FIGS. 1 and 2 illustrate the improved projectile launcher 10 of the present invention. More particularly, the projectile launcher 10 is shown installed on the upper receiver 96 of a firearm 102, which is an AR-15 rifle in the current embodiment, but can also be an M-16 rifle or any other suitable firearm system. The upper receiver has a front 98, rear 100, and forwardly protruding barrel nut threads 102. A projectile 52 is loaded within the central projectile bore 32 of the elongated, cylindrical gas tube body 12. In the current embodiment, the projectile is a full beverage can. The body has an open front end 14, a partially closed rear 16, a top exterior 18, a bottom exterior 20, a right exterior 22, and a left exterior 24. The rear of the body defines a central threaded aperture 26 that acts like a barrel nut and is threadedly connected to the barrel nut threads to attach the body to the front of the upper receiver. In the current embodiment, the body is 9 inches long and has an internal diameter of 2.62 inch. However, the body can be of any desired length or width to accommodate the shape of a variety of projectiles.

The right exterior 22 of the body 12 defines a right latch aperture 28, and the left exterior 24 of the body defines a left latch aperture 30. The central projectile bore 32 of the body defines a central bore axis 34. The rear 40 of a right latch element 36 is attached to the right exterior of the body. The front 38 of the right latch element includes a V-shaped latch portion 42 that provides a rearward facing cam surface that is offset at a selected angle from a transverse plane perpendicular to the bore axis and is movable between a retention portion in which the latch portion protrudes into the projectile bore by a first amount through the right latch aperture to a first distance from the central bore axis and a release position in which the latch portion protrudes into the projectile bore by a lesser second amount through the right latch aperture to a second amount that is a greater distance from the bore axis, which can include being clear of the projectile bore. The right latch element is biased to the retention position. The rear 48 of a left latch element 44 is attached to the left exterior of the body. The front 46 of the left latch element includes a V-shaped latch portion 50 that provides a rearward facing cam surface that is offset at a selected angle from a transverse plane perpendicular to the bore axis and is movable between a retention portion in which the latch portion protrudes into the projectile bore by a first amount through the left latch aperture to a first distance from the central bore axis and a release position in which the latch portion protrudes into the projectile bore by a lesser second amount through the left latch aperture to a second amount that is a greater distance from the bore axis, which can include being clear of the projectile bore. The left latch element is biased to the retention position.

The projectile 52 loaded into the projectile bore 32 has a front rim 54, rear rim 56, right exterior 58, and left exterior 60. The projectile bore is sized to closely receive the projectile while still permitting the projectile to slide longitudinally within the projectile bore. An internal step 62 protrudes into the projectile bore from the body to support the rear rim of the projectile at a desired height within the projectile bore. The right latch aperture 28 and left latch aperture 30 are positioned such that the right latch portion 42 and left latch portion 50 protrude through the right and left latch apertures at a location contacting the front rim of the projectile in the current embodiment. Alternatively, the right and left latch apertures can be located above the front rim of the projectile or along the exterior of the projectile. The biasing of the right and left latch portions to the retention position releasably retains the projectile within the projectile bore until the projectile exert sufficient force to overcome the biasing of the right and left latch portions. In the current embodiment, the right and left latches are a pair of leaf springs diametrically opposite each other on the body so as to be evenly distributed about the body at a common position along the length of the body. The location of the internal step and the locations and quantity of latch apertures and latch elements with latch portions can be changed to accommodate any desired projectile shape and create any desired retention force. In addition, the latch elements can be any variety of mechanical, spring-driven, or hard object with flexibility, either mechanically or electronically controlled, to release from the projectile when the projectile exerts an optimal force against the one or more latch elements.

A gas inlet facility including a gas barrel 64 and a barrel extension 80 are received within the rear 16 of the projectile bore 32 through the threaded aperture 26 at the rear 16 of the body 12. The gas barrel has a closed front and 66, a threaded rear 68, a threaded tip accessory mount 70, a blockage/dead space 72 immediately rearward of the accessory mount separating the blockage/dead space from a gas port 74, a blocking bar 76 located rearward of the gas port, a cartridge chamber 78 in fluid communication with the gas port via a barrel bore 106, and defines a barrel axis 104. The front 82 of the barrel extension is threadedly connected to the threaded rear of the gas barrel, and the rear 84 of the barrel extension protrudes rearwardly through the threaded aperture at the rear of the body 12 into the front 98 of the upper receiver 96. In the current embodiment, the barrel extension is a standard barrel extension fitting all AR-15 rifle 104 bolt heads (not shown) that lock a cartridge (such as blank cartridge 86) within the chamber until after the cartridge has discharged. The gas barrel 64 has a pair of opposing gas ports 74 transverse to the barrel axis in the current embodiment, but any desired quantity, arrangement, and shape of gas ports, slots, and fins can be present. In addition, the gas barrel can be any length, width, and shape to accommodate any desired caliber of blank cartridge.

FIG. 2 shows a blank cartridge 86 having a front 88 and a rear 90 loaded into the chamber 78. The dashed lines illustrate the position a bullet 92 having a bullet nose 94 would occupy if the blank cartridge were instead a live round. It should be appreciated that the blocking bar 76 protrudes in front of the neck of the cartridge casing and occupies the space the bullet would have to occupy for a live round to be loaded into the chamber. As a result, it is impossible for a live round to be loaded into the chamber of the projectile launcher 10. However, the blocking bar does permit the passage of gas generated by the discharge blank cartridge so the gas can flow through the gas port 74 and enter the projectile bore 32 behind the rear rim 56 of the projectile 52. In the current embodiment, the blocking bar is a transverse pin intersecting the barrel bore 106 that provides an obstruction partially obstructing the bore, but the obstruction can also be a sharp edge that protrudes in front of the neck of an ammunition casing and prevents the loading of a live round. The blocking bar is removable and replaceable to allow for erosion because of propellant gases emitted by a discharged blank cartridge in the current embodiment. Furthermore, the blockage/dead space 72 also prevents the bullet from a discharged live round from passing past the gas port that is forward of the blocking bar and exiting from the front 66 of the gas barrel, which provides an additional safety feature and further ensures the projectile launcher of the current invention is not regulated as a firearm by the US Bureau of Alcohol, Tobacco, Firearms, and Explosives. Finally, the omission of a gas tube to transfer a portion of the high-pressure gas back to the bolt carrier (not shown) prevents automatic cycling of the action (not shown).

The cartridge chamber 78 has a contour 108 adapted to closely receive a selected rifle cartridge type, the contour includes a casemouth feature 110 corresponding to a casemouth of the selected rifle cartridge, the contour having a bore portion 112 extending forward of the casemouth feature, and the barrel including a blocking bar 76 obstruction partially obstructing the bore portion at a selected limited distance forward of the casemouth feature, the selected limited distance being less than the amount by which a bullet of the selected rifle cartridge type protrudes from the casemouth, such that the obstruction prevents the chambering of a conventional cartridge of the selected cartridge type, and enables the chambering of a blank cartridge based on the selected cartridge type.

Figure 3:
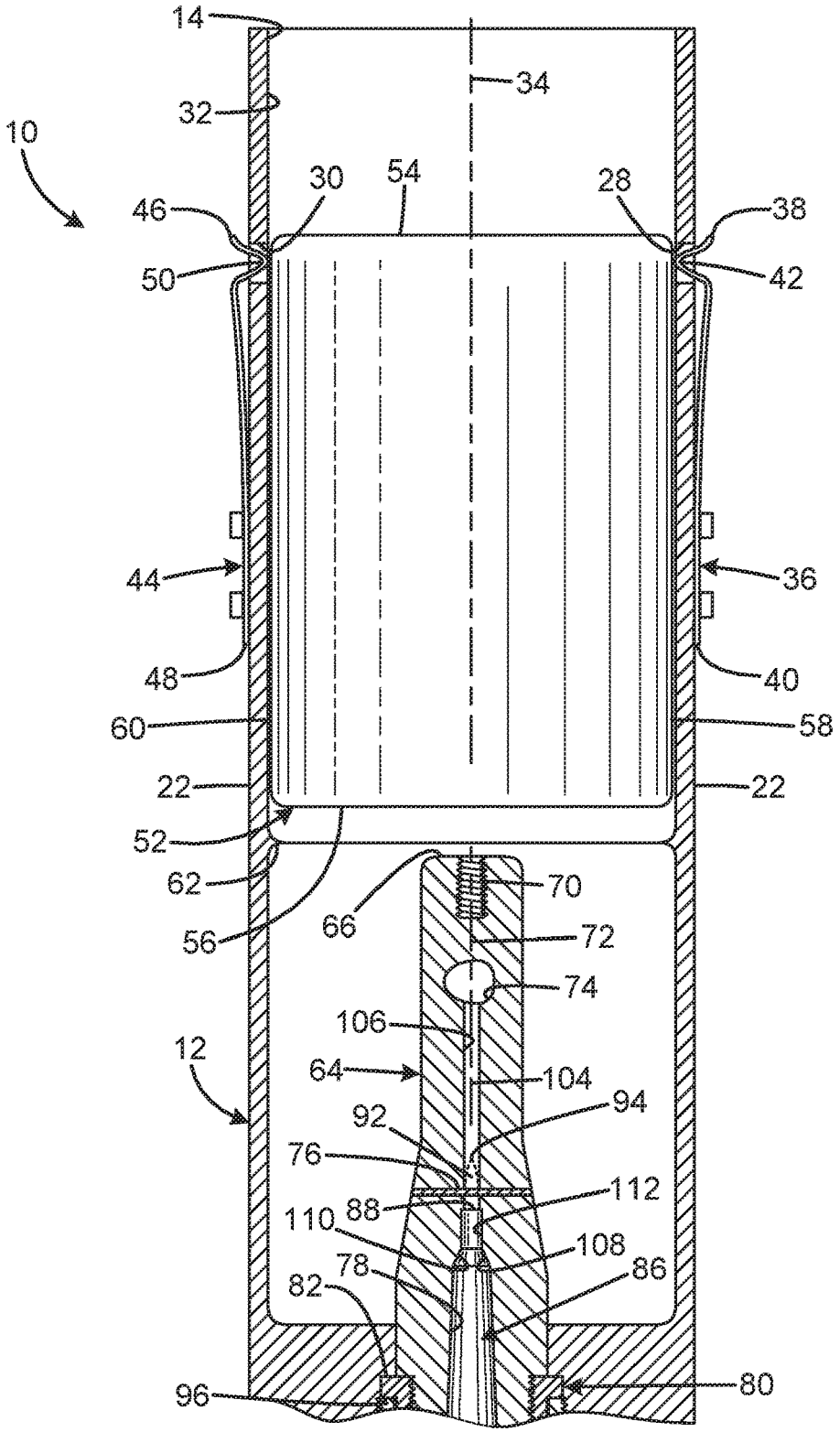
FIG. 3 is an enlarged top sectional view of the current embodiment of the projectile launcher of FIG. 1 after the projectile has begun to launch with the latch elements in the release position.

FIG. 3 illustrates the improved projectile launcher 10 of the present invention. More particularly, the projectile launcher 10 is shown shortly after the blank cartridge 86 has discharged. Gas generated by the discharged cartridge has flowed around the blocking bar 76 and exited from the gas barrel 64 through the gas ports 74 into the projectile bore 32 behind the rear rim 56 of the projectile 52. The gas has built up behind the projectile until the gas pressure exerts sufficient force upon the rear of the projectile that the projectile exert sufficient forward force upon the right and left latch elements 36, 44 to overcome the retention force resulting from the biasing of the right and left latch elements and move the right and left latch elements into the release position, thereby launching the projectile. The need to overcome the selected amount of retention force exerted by the right and left latch elements is critical to ensuring the reliability of the projectile launcher of the current invention. This is because blank cartridges have considerable variation in their performance. There is also a need to not expose the projectile directly to the high-pressure gases resulting from discharge of the blank cartridge. Instead, the high-pressure gas is directed into the initially low-pressure portion of the projectile bore behind the projectile, and the pressure exerted on the projectile is increased gradually instead of instantaneously subjecting the rear of the projectile to the high-pressure gas generated by the discharged blank cartridge. The retention force is selected such that the pressure build up behind the projectile is sufficient to maximize the flight of the projectile without subjecting the projectile to such high pressure is that the projectile is damaged during launch. Furthermore, in the absence of retention force, much lower gas pressure accumulates behind the projectile prior to launch, resulting in significantly decreased projectile flight.

In alternative versions of the invention, using the threaded tip accessory mount when needed, the projectile can be a grappling hook, net launcher, dog training toys for duck hunting and retrieval, a t-shirt, a lawn dart, or a harpoon. The current invention is also operable to launch a baseball and a tennis ball as well as any heavy, thin-walled object without modification.

While a current embodiment of a projectile launcher has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A launcher comprising:

an elongated cylindrical body defining a projectile bore having a bore axis;

the body having an open forward exit end;

the body having a gas inlet facility at an opposed rear end;

a movable latch element connected to the body and having a latch portion movable between a retention position in which the latch portion protrudes into the bore and a release position;

the latch element being biased to the retention position such that a projectile in the bore rearward of the latch is retained by the latch portion except until a gas pressure above a selected amount builds up behind the projectile to overcome the biasing of the latch and launch the projectile;

wherein the body defines a latch aperture, and wherein a first portion of the latch resides outside the bore, and the latch portion extends through the latch aperture onto the bore; and wherein the latch aperture is located at an intermediate position on the body between the exit end and the rear end.

2. The launcher of claim 1 wherein the latch element is clear of the bore when in the release position.

3. The launcher of claim 1 wherein the latch portion protrudes in to the bore by a first amount when in the retention position, and protrudes into the bore by a lesser second amount when in the release position.

4. The launcher of claim 1 wherein the rear of the body is closed except at the gas inlet facility.

5. The launcher of claim 1 wherein the latch portion is proximate the forward exit end of the body.

6. The launcher of claim 1 wherein the latch is a leaf spring.

7. The launcher of claim 1 including a pair of latches.

8. The launcher of claim 7 wherein the latches are diametrically opposite each other on the body.

9. The launcher of claim 1 including a plurality of latches evenly distributed about the body.

10. The launcher of claim 1 including a plurality of latches all positioned at a common position along the length of the body.

11. The launcher of claim 1 wherein the latch portion has a rearward facing cam surface that is offset at a selected angle from a transverse plane perpendicular to the bore axis, such that the latch is responsive to forward force by a projectile to move the latch to the release position.

12. A launcher comprising:

a body defining a projectile bore on a bore axis;

the body having an open forward exit end;

the body having a gas inlet facility at an opposed rear end;

a movable latch element connected to the body and having a latch portion movable between a retention position in which the latch portion protrudes into the bore to a first distance from the bore axis and a release position in which the latch portion is a greater distance from the bore axis;

the latch element being biased to the retention position to retain a projectile in the bore when the projectile is applying a forward force on the latch less than a preselected amount, and to release the projectile when a forward force exceeds the preselected amount;

wherein the body defines a latch aperture, and wherein a first portion of the latch resides outside the bore, and the latch portion extends through the latch aperture onto the bore; and wherein the latch aperture is located at an intermediate position on the body between the exit end and the rear end.

13. The launcher of claim 12 wherein the rear of the body is closed except at the gas inlet facility.

14. The launcher of claim 12 wherein the latch portion is proximate the forward exit end of the body.

15. The launcher of claim 12 wherein the latch is a leaf spring.

16. The launcher of claim 12 including a pair of latches.

17. The launcher of claim 12 wherein the latch portion has a rearward facing cam surface that is offset at a selected angle from a transverse plane perpendicular to the bore axis, such that the latch is responsive to forward force by a projectile to move the latch to the release position.

18. The launcher of claim 12 wherein the gas inlet facility is a barrel chambered to receive a cartridge.

* * * * *